US005346139A

United States Patent [19]

Davis et al.

[11] Patent Number: 5,346,139

[45] Date of Patent: Sep. 13, 1994

[54] TRANSFER OF ELECTROSTATIC CHARGE THROUGH A TURBINE DRIVE SHAFT TO A ROTARY ATOMIZER HEAD

[75] Inventors: Dennis Davis, Bay Village; Harold Beam, Oberlin, both of Ohio

[73] Assignee: Nordson Corp., Westlake, Ohio

[21] Appl. No.: 171,027

[22] Filed: Dec. 21, 1993

Related U.S. Application Data

[63] Continuation of Ser. No. 985,058, Dec. 3, 1992, abandoned.

[51] Int. Cl.[5] ..... B05B 5/04

[52] U.S. Cl. ..... 239/703; 239/223; 239/700

[58] Field of Search ..... 239/700, 701, 702, 703, 239/706, 223, 224

[56] References Cited

U.S. PATENT DOCUMENTS

| | | |
|---|---|---|
| 2,728,607 | 12/1955 | Smart . |
| 2,799,532 | 7/1957 | Smart . |
| 2,809,902 | 10/1957 | Ransburg . |
| 2,989,241 | 6/1961 | Badger . |
| 3,009,441 | 11/1961 | Juvinall . |
| 3,048,498 | 8/1962 | Juvinall et al. . |
| 3,826,425 | 7/1974 | Scharfenberger et al. . |
| 3,862,821 | 1/1975 | Vorms et al. . |
| 4,037,561 | 7/1977 | LaFave et al. . |
| 4,114,564 | 9/1978 | Probst . |
| 4,369,924 | 1/1983 | Morishita et al. . |
| 4,407,217 | 10/1983 | Jackson . |
| 4,422,577 | 12/1983 | Arnold et al. . |
| 4,505,430 | 3/1985 | Rodgers et al. . |
| 4,555,058 | 11/1985 | Weinstein et al. . |
| 4,584,000 | 4/1986 | Guest . |
| 4,688,518 | 8/1987 | Missier . |
| 4,718,920 | 1/1988 | Kinsey et al. . |
| 4,776,520 | 10/1988 | Merritt . |
| 4,854,500 | 8/1989 | Mathai et al. . |
| 4,887,770 | 12/1989 | Wacker et al. . |
| 4,943,005 | 7/1990 | Weinstein . |
| 5,078,321 | 1/1992 | Davis et al. . |
| 5,100,057 | 3/1992 | Wacker et al. . |

*Primary Examiner*—Andres Kashnikow
*Assistant Examiner*—Christopher G. Trainor
*Attorney, Agent, or Firm*—Howard M. Cohn

[57] ABSTRACT

A rotary atomizer having a low capacitance, cup-shaped, atomizing head mounted for rotation about an axis of rotation has a coating material flow surface forming a forward cavity. A rotary drive means coupled to the atomizing head rotates the atomizing head about the axis of rotation. High voltage electrostatic energy is conducted through the rotary drive means directly into the atomizing head whereby charged coating material flows outwardly across the flow surface.

18 Claims, 2 Drawing Sheets

TRANSFER OF ELECTROSTATIC CHARGE THROUGH A TURBINE DRIVE SHAFT TO A ROTARY ATOMIZER HEAD

This is a continuation of copending application Ser. No. 07/985,058 filed on Dec. 3, 1992 now abandoned.

FIELD OF THE INVENTION

This invention relates to a rotary atomizing liquid spray coating apparatus and more particularly to a rotary atomizing apparatus wherein high electrostatic charge is transferred through a turbine drive shaft to a high speed atomizer head secured at one end thereof.

BACKGROUND OF THE INVENTION

Rotary atomizers are a type of liquid spray coating apparatus which includes an atomizer head rotatable at high speed (typically 10,000–40,000 revolutions per minute) to apply liquid coating material in atomized form onto the surface of a workpiece. The head is usually in the form of a disc or cup which includes an interior wall defining a cavity and terminating in an atomizing edge. Liquid coating material delivered to the interior of the cup migrates outwardly under centrifugal force along the wall until it is flung from the edge of the cup and thereby atomized. To improve the transfer efficiency of the coating process, an electrostatic charge is imparted to the coating material so that the atomized coating material is attracted to an electrically grounded workpiece. An example of an electrostatically charged type rotary atomizer is disclosed in commonly assigned U.S. Pat. No. 4,887,770 ('770) to Wacker et al., which is expressly incorporated herein in its entirety by reference. In the FIG. 12 embodiment of the '770 patent, the cup (20) is made from an insulative material and includes a semi-conductive ring (546) which is charged through posts (504) by three external electrode probes (462). This system suffers from a drawback in that the front end of the housing from which the cup protrudes has a large profile which causes the air currents, generated by the high speed rotation off the cup, to create a vacuum around the front end of the housing which in turn causes the paint to wrap back onto the housing. While this problem has been addressed by directing auxiliary air around the front end of the housing to break up the vacuum, there is a need for an atomizer which does not cause wrap back and does not create a safety hazard.

Prior to the '770 patent, one of the hazards associated with the use of the conductive atomizing cup was the possibility of operator shock or ignition of combustible coatings because of the high voltage at which the cups were maintained. For example, as disclosed in U.S. Pat. No. 4,369,924, charge is transferred through a turbine shaft from a power supply to the rotary atomizer cup. However, both the cup and the entire rotary atomizing housing are metal and are charged to a high voltage. With this type of construction, there is a significant safety hazard since the atomizer carries sufficient charge to shock an operator severely and therefore protective fences and interlocks have to be installed around the atomizer.

The '770 patent, listed before, teaches a low capacitance, rotary atomizer which while electrostatically charging the paint at the rotary atomizer cup does not store sufficient charge to present a shock hazard and therefore does not have to be protected by fences and safety interlocks. However, since the cup (20) is charged through external electrode probes (462), the system suffers from the drawback that the front end of the housing has a large profile with the attendant problems discussed before.

In another type of rotary atomizer, as disclosed in U.S. Pat. No. 3,826,425, a disk (11) comprised of both insulative and conductive parts, is charged by power supply (21) through cable (22), resistor (23), conductive foam (63), semi-conductive rod (62), semi-conductive ring (61), air gap (39), first semi-conductive plastic rod (24), semi-conductive plug (60), second semi-conductive plastic rod (24) and conductive ink (38). This system suffers from the drawback that the electrical path is made up of a large number of parts which increases the chance of system failure. Also, since the electrical path is spaced outwardly from the rotary shaft, the outer periphery of the front end of the housing has a large profile which causes the paint to wrap back onto the housing.

OBJECTS AND SUMMARY OF THE INVENTION

It is an object of the present invention to provide an apparatus for transferring charge through a turbine drive shaft to a cup in a low capacitance type rotary atomizer to obviate the problems and limitations of the prior art systems.

It is a further object of the present invention to provide an apparatus for transferring charge through a turbine drive shaft to a cup in a low capacitance type rotary atomizer to reduce the profile of the housing and substantially eliminate wrap back of paint onto the housing.

It is another object of the present invention to provide an apparatus for transferring charge through a turbine drive shaft to a head in a low capacitance type rotary atomizer without requiring protective fences and interlocks to be installed around the atomizer to prevent an operator from being shocked by the charge.

In accordance with the invention, a rotary atomizer comprises a non-electrically conductive housing having a forward end and a rearward end and defining an interior chamber therebetween. Rotary drive means disposed within the interior chamber and coupled to a cup-shaped, atomizing head located outside of the forward end of the housing rotates the cup-shaped atomizing head about an axis of rotation extending longitudinally through the housing. Means are provided for supplying liquid coating material to the cup-shaped, atomizing head. Means conduct high voltage electrostatic energy through the rotary drive means and directly into the cup-shaped, atomizing head without conducting the high voltage electrostatic energy through the housing. The cup-shaped atomizing head is constructed of a composite material including a low capacitance insulating material and electrically conducting material whereby the high voltage electrostatic energy is transmitted from the rotary drive means through the cup-shaped, atomizing head to charge the coating material with high voltage electrostatic energy by contact with at least a part of the electrically conducting material in the atomizing head.

Further in accordance with the invention, the drive means includes an air turbine motor coupled by a drive shaft to the cup-shaped, atomizing head. The drive shaft has a bore aligned with the rotary axis and extending therethrough. A feed tube removably received within the bore is in communication with the atomizing head for supplying liquid coating material to the flow surface of the atomizing head when the atomizing head is rotating about the rotary axis. The motor is mounted in the interior chamber of a motor housing having a forward end and a rearward end and defining the interior chamber therebetween.

In accordance with the invention, the means for conducting high voltage electrostatic energy through the rotary drive means includes means for directing high voltage electrostatic energy to the drive shaft for conduction directly therethrough and into the cup-shaped, atomizing head. In one embodiment, the means for directing the high voltage electrostatic energy includes a feed tube removably received within the bore and in communication with the atomizing head for supplying liquid coating material to the flow surface of the atomizing head. The feed tube conducts the high voltage electrostatic energy into the drive shaft and into the atomizing head. The feed tube has a first end which is engaged with the motor so as to be supported in cantilevered fashion free of electrical contact with the wall of the bore and a second end in close proximity to the atomizing head. In another embodiment, the means for supplying high voltage electrostatic energy includes means for directing high voltage energy into turbine blades of the air turbine motor which in turn conducts the high voltage energy into the drive shaft. The means for directing electrostatic energy into the turbine blades includes charging electrode means mounted in close proximity to the turbine blades for transmitting the high voltage energy across a gap into the turbine blades and through the drive shaft to the atomizing head. In a third embodiment, the means for conducting high voltage electrostatic energy through the rotary drive means includes means encircling the drive shaft for transmitting the high voltage energy into the drive shaft for conduction directly therethrough and into the atomizing head. The means encircling the drive shaft are located in closely spaced proximity to the drive shaft whereby the electrostatic energy is transmitted across a gap to the drive shaft. The encircling means is a contact free, bearing device arranged in the motor housing for axially supporting the drive shaft in a non-contact state.

In accordance with the invention, one embodiment of the cup-shaped, atomizing head is constructed of a composite material including an electrically conducting material and a reinforcing material including an electrically non-conducting binder material whereby the coating material is charged with high voltage electrostatic energy from contact with the composite material. The electrically conducting material is about 3 to 8 weight percent of the total weight of the composite and preferably about 5 to 6 weight percent of the total weight of the composite. The reinforcing material is about 20 to 40 weight percent of the total weight of the composite and preferably about 25 to 35 weight percent of the total weight of the composite. The reinforcing material includes an electrically non-conducting binder material having a weight percent of about 65 weight percent of the total weight of the composite.

Also in accordance with the invention, the cup-shaped, atomizing head has a mounting chamber threadedly secured to the drive shaft and a rear cavity disposed between the mounting chamber and a forward cavity having the flow surface. The rear cavity is separated by a divider from the forward cavity. A plurality of holes connect the rear cavity to the forward cavity whereby the coating material delivered to the rear cavity can flow from the rear cavity through the holes to the forward cavity and across flow surface just prior to being expelled from an atomizing edge in a charged state.

In another embodiment, the cup-shaped, atomizing head has charging electrode means embedded in the composite material and extending from the mounting chamber to a flat, circular, ring shaped charging electrode embedded in the flow surface. The charging electrode means is formed of an electrically conductive composite material including electrically non-conducting, binder and electrically conducting materials. The electrically conducting material is about 3 to 8 weight percent of the total weight of the composite and preferably about 5 to 6 weight percent of the total weight of the composite.

BRIEF DESCRIPTION OF THE DRAWINGS

The structure, operation, and advantages of the presently preferred embodiment of the invention will become further apparent upon consideration of the following description taken in conjunction with the accompanying drawings, wherein.

DETAILED DESCRIPTION OF THE INVENTION

Figure 1:
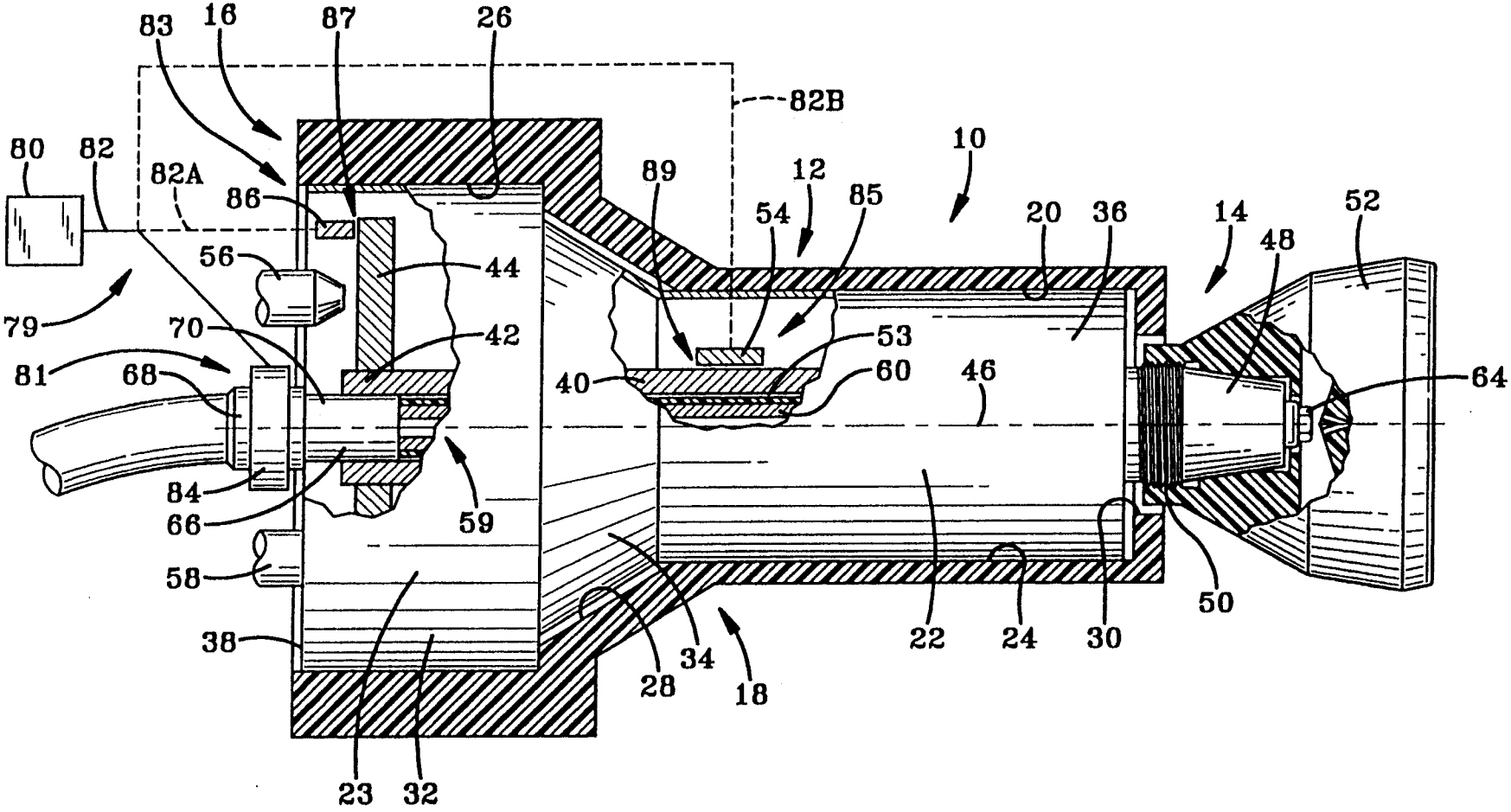
FIG. 1 is a partial longitudinal, cross sectional view of a rotary atomizer illustrating several alternative means of supplying charge to be transferred through the turbine drive shaft to the cup in accordance with the present invention.

Referring to FIG. 1, a rotary atomizer 10 constructed in accordance with the invention is shown. The atomizer includes a motor housing 12, preferably formed of an electrically, non-conductive material, with a forward end 14, a rearward end 16 and an intermediate section 18 defining an interior chamber 20 in which a rotary drive means 22 is mounted. The interior chamber 20 is defined by a first cylindrical bore 24, a second cylindrical bore 26 of a larger diameter then the first cylindrical bore and a frustro-conical bore 28 interconnecting the first and second bores 24,26. Forward end 14 has a through bore 30 opening into first cylindrical bore 24 of chamber 20. Rearward end 16 opens into second cylindrical bore 26 of chamber 20. The motor housing 12 can be attached by any conventional means (not shown) to a fixed support or to a movable support such as a robot.

The rotary drive means 22 includes an air turbine motor 23 having a cylindrically shaped rear section 32 disposed in the cylindrical bore 26, a frustro conically shaped intermediate section 34 received within frustro-conical bore 28 and a cylindrically shaped front section 36 received within first cylindrical bore 24. The motor 23 is securely held in place within interior chamber 20 by conventional means such as one or more clamps (not shown) which are connected to the rearward end 16 of housing 12 and the base 38 of motor 23.

A motor drive shaft 40 is connected at a first end 42 to turbine blades 44 disposed in the rear section 32 of motor 23 and extends forward about an axis 46 of rotation to traverse the entire length of motor 23 so that the opposite second end 48 of drive shaft 40 projects outward from through bore 30 of housing 12. The second end 48 has a threaded section 50 and a frustro-conically shaped end adapted to securely receive a cup shaped, rotary atomizer head 52. Motor drive shaft 40 has a through bore 53 which is aligned with axis 46 and extends the length of the drive shaft. The external and internal surfaces of drive shaft 40 can be coated with an electrically non-conductive material 55, such as for example a polymeric material. The area of the external surface of drive shaft 40 which is in contact with an adjacent element into which high voltage energy is to be directed, is free of the coating material. Motor 23 preferably comprises an air driven type turbine which includes internal air bearings 54, a driving air inlet 56 and a braking air inlet 58 for controlling the high speed rotation of head 52, all of which components are well known in the art.

A means 59 for supplying coating material includes a removable coating material feed tube 60 which extends through bore 43. Tube 60 has a first end 62 which communicates with the interior of atomizer head 52 and which preferably carries a removable nozzle 64 and an opposed second end 66 having a female fluid coupling 68. Coupling 68 has a base 70 which is frictionally and removably received (not shown) within the base 38 of motor 23. When engaged within the base of motor 23, feed tube 60 is supported in cantilever fashion free of contact from the wall of bore 53, as disclosed in commonly assigned U.S. Pat. No. 5,100,057 ('057) to Wacker et al., which is expressly incorporated herein in its entirety by reference. As further disclosed in commonly assigned U.S. Pat. No. 5,078,321 ('321) to Wacker et al., which is expressly incorporated herein in its entirety by reference, feed tube 60 preferably has a first portion 72 formed of a rigid electrically conductive material, a second portion 74 formed of an electrically non-conductive material and a covering layer 76 of heat shrinkable, non-conductive material. Alternatively, the feed tube 60 could be made of conductive material, such as stainless steel. As with the drive shaft 40, the external surface of feed tube 60 can be coated with an electrically non-conductive material, such as for example a polymeric material, as required.

Figure 2:
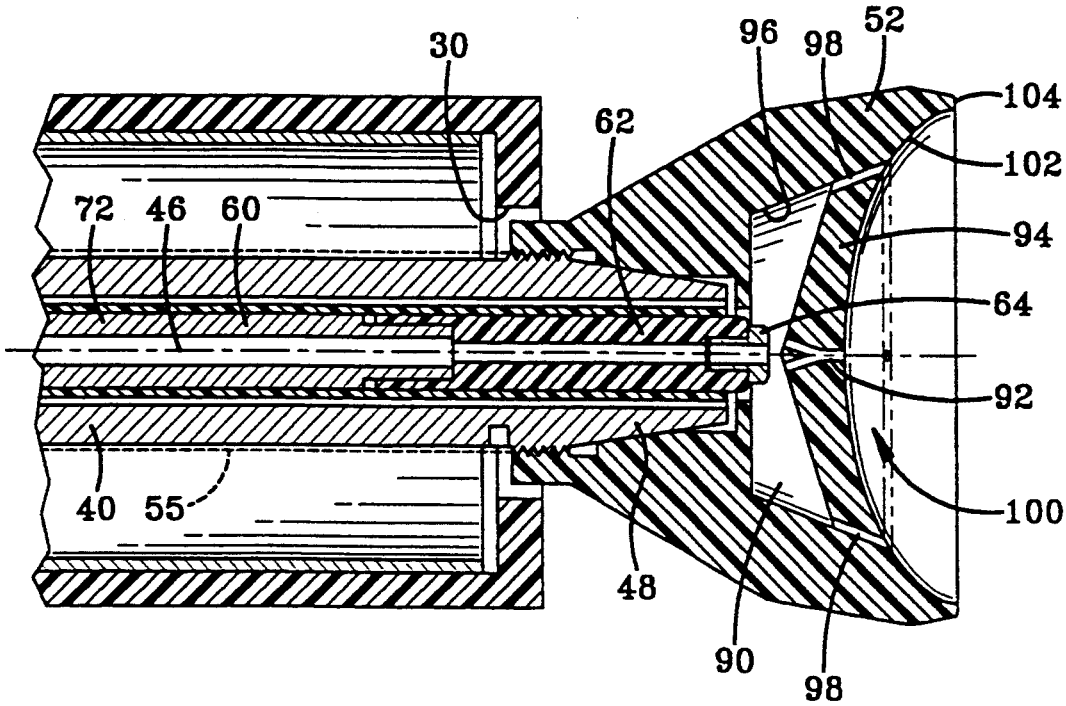
FIG. 2 is a partial longitudinal, cross sectional view showing the forward end of a first embodiment of the rotary atomizer of FIG. 1 in further detail.

Referring now to FIGS. 1 and 2, an important aspect of this invention is the means 78 for conducting high voltage electrostatic energy through the rotary drive means 22 and directly into cup-shaped, atomizing head 52 secured to the second end 48 of drive shaft 40. The means 78 for conducting high voltage energy includes means 79 for supplying high voltage energy to the drive shaft 40 for conduction directly therethrough and into the atomizing head 52. Means 79 includes an external high voltage generator 80 used for generating high voltage electrostatic energy.

In one embodiment, means 79 for supplying high voltage energy includes means 81 for directing an electrical charge into a feed tube 60 removably received within the bore 53. Means 81 includes a line 82 connecting an externally located high voltage generator 80 to a terminal 84 attached to the second end 66 of feed tube 60, such as a collar secured about coupling 68. In this embodiment, the high voltage electrostatic energy is transmitted to the cup-shaped, atomizing head 52, as described in more detail below, via the second end 66 of tube 60 which is in direct contact with motor drive shaft 40. While high voltage generator 80 is preferably located externally from the motor housing 12, it is within the terms of the invention to locate generator 80 internally of housing 12.

In an alternative embodiment, means 79 for supplying high voltage electrostatic energy through the drive shaft 40 includes means 83 for directing high voltage electrical energy into turbine blades 44 of the air turbine motor 23 which in turn conducts the high voltage energy into the drive shaft 40. Means 83 for directing high voltage electrical energy includes a power line 82A connecting external high voltage generator 80 to an electrode 86 which is disposed in close proximity to the turbine blades 44 to form a gap 87. The electrostatic energy is transmitted from line 82A, across gap 87 to the turbine blades, into the motor drive shaft 40 and ultimately into atomizing head 52, as described in more detail below.

In another alternative embodiment, means 79 for supplying high voltage electrostatic energy includes means 85 encircling drive shaft 40 for directing the high voltage electrostatic energy into drive shaft 40 and directly therethrough and into the cup-shaped, atomizing head 52. Means 85 includes a power line 82B connecting external high voltage generator 80 to air bearing 54 which is disposed in close proximity to motor drive shaft 40 to form a gap 89. The electrostatic energy is transmitted from line 82B, across gap 89 to drive shaft 40 and ultimately into atomizing head 52, as described in more detail below. For a detailed description of a suitable air bearing 54 used in the rotary atomizer 10 of FIG. 1, see FIG. 1 and column 4, lines 30–60 of the U.S. Pat. No. 4,369,924 to Morishita et al., which is expressly incorporated herein by reference.

Figure 3:
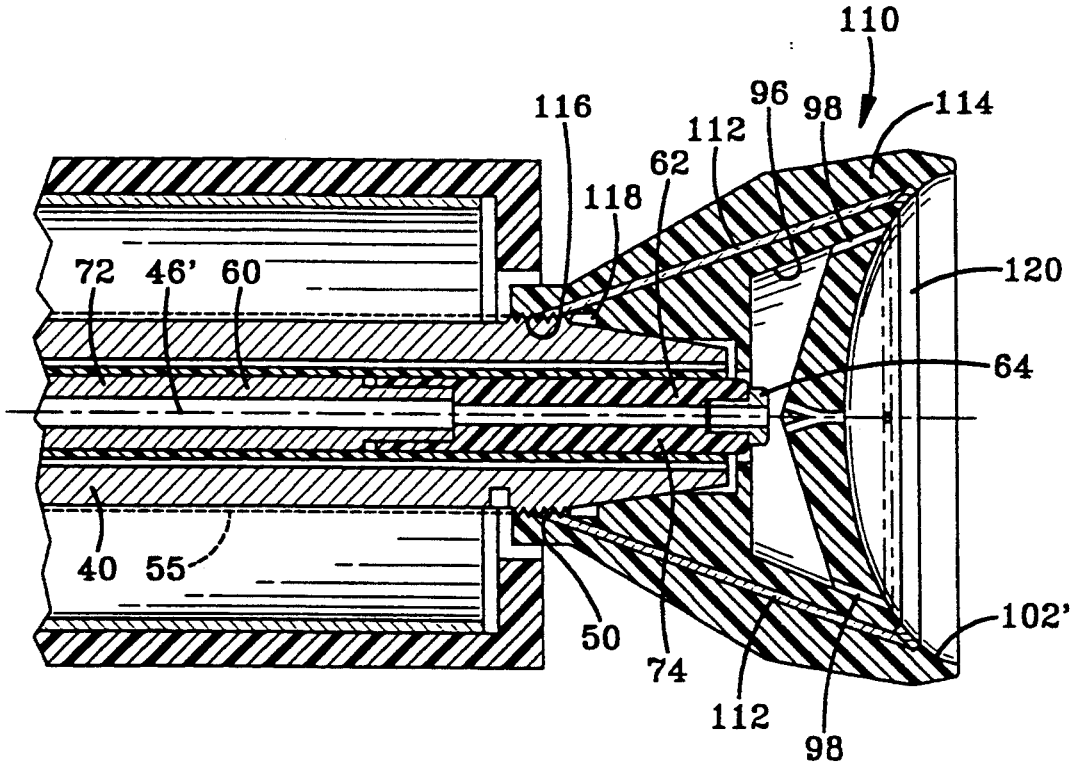
FIG. 3 is a partial longitudinal, cross sectional view showing the forward end of a second embodiment of the rotary atomizer of FIG. 1 in further detail.

The atomizer head 52 is threaded onto the end of rotary drive shaft 40, as illustrated in FIGS. 1–3. For a detailed description of a suitable atomizer head 52 used in the rotary atomizer 10, see FIG. 1 and column 4, line 57-column 5, line 29 of the '321 patent listed above. The head 52 , as illustrated in FIG. 2 , is uniformly constructed of a composite material including a low capacitance insulating material and an electrically conducting material.

The low capacitance insulating material is a non-conducting, reinforcing material selected to provide the composite with the desired mechanical properties such as good impact and tensile strength and dimensional stability. Further, the low capacitance insulating material includes the properties of heat and electrical resistance and chemical and mechanical resistance to the action of the ingredients of the coating material. A preferred type of reinforcing insulating material is glass fiber but other organic or synthetic fibers can be used. The total weight percent of the reinforcing material to the total weight of the composite is about 20 to 40 weight percent and preferably about 25 to 35 weight percent and most preferably about 30 weight percent. The weight percent of the reinforcing material can be varied as long as the reinforcing material performs its intended function.

The binder material should possess such properties as good heat and electrical resistance and good chemical and mechanical resistance to the action of the ingredients of the coating material. A polymeric material such as PEEK (polyetheretherketone) available from I.C.I. of America is suitable. The total weight percent of the binder material to the total weight of the composite is about 65 weight percent. The weight percent of the binder material can be varied as long as the binder material performs its intended function.

The electrically conducting material is a carbon containing material, and more particularly a carbon fiber, however other electrically conducting materials such as carbon black or particulate graphite can be used. The weight percent of carbon fiber in the head 52 is selected to provide a desired resistivity. A suitable weight percentage of carbon fiber to the total weight of the composite is about 3 to 8 weight percent, and preferably about 5 to 6 weight percent of the total weight of the composite. Composites containing more than about 8 percent by weight carbon fiber appear to be too conducting, whereas composites containing less than about 3 percent by weight of carbon fiber appear to be too non-conducting.

In operation, head 52 is rotated at high speed in accordance with the air pressure applied to driving air inlet 56 and braking air inlet 58. Concurrently high voltage electrostatic energy is conducted through the rotary drive means 22 directly into atomizing head 52 secured to the second end 48 of drive shaft 40. The electrostatic energy is directed from the high voltage generator 80 to drive shaft 40 and ultimately into atomizing head 52, in accordance with principles described before. While the electrostatic energy is preferably conducted from the second end 48 of drive shaft 40 into the head 52 via the threaded section 50, it is also within the terms of the invention to conduct the electrostatic energy across the frustro-conically shaped end onto which the cup shaped, rotary atomizer head 52 is securely attached.

To commence spraying, the fluid material applied to the feed tube 60, flows through nozzle 64 and into cup-shaped, atomizing head 52, see FIG. 3 and column 12, line 60-column 13, line 30 of the '057 patent listed above. The fluid material then flows into the rear cavity 90 of the head 52. Then, some of the liquid flows through opening 92 provided in the divider 94 to maintain the forward surface of divider 94 in a wetted condition. The majority of the coating material, however, is forced along wall 96 due to centrifugal force and caused to migrate along wall 96 outwardly through holes 98 into the forward header cavity 100. Then the coating material flows across flow surface 102 just prior to being expelled from atomizing edge 104 to effect atomization. Throughout the contact of the coating material with the surfaces of header 52, electrostatic charge is imparted to the coating material. The resulting cloud of charged coating material is propelled forward toward a workpiece.

Since the electrostatic charge is conducted through drive shaft 40, in accordance with the principles of the present invention, the motor housing 12 can be constructed with forward end 12 disposed coincident with centerline 46 and having a diameter which is less than the diameter of the atomizing edge 104 of rotary head 52. The effect of this relationship, i.e., the profile of the motor housing to the rotary head, is the substantial eliminations of the wrap back of paint onto the motor housing. The heads 52 and 110, as illustrated in FIGS. 2 & 3 have their threaded sections at the base of the head partially disposed within the opening 30. Since drive shaft 40 is typically coated with an electrically non-conductive material, the charge can be transferred through drive shaft 40 to the head in a low capacitance type rotary atomizer without requiring protective fences and interlocks to be installed around the atomizer to prevent an operator from being shocked by the charge. Another advantage of the improved motor housing design, as disclosed herein, is the light weight of the improved rotary and its ability to be easily adapted for automatic control by a robot.

While the above described embodiments of the invention provide a very effective means of transferring charge through a turbine drive shaft 40 to a rotary head and then to coating material, it is also within the terms of the invention to provide an alternative embodiment wherein rotary atomizer head 52 is replaced with an alternative rotary atomizer head 110, as illustrated in FIG. 3. The head 110 is generally constructed of a composite material including a low capacitance insulating material and an electrically non-conducting binder material of the types described in the embodiment illustrated in FIG. 2. The head 110 includes a plurality of equally spaced, rod shaped charging electrodes 112 embedded in the wall 114 and which extend from the threaded surface 116 of the mounting chamber 118 to a flat, circular, ring shaped charging electrode 120 embedded in the wall 114 and forming a portion of the flow surface 102'. Throughout the specification, primed numbers represent structural elements which are substantially identical to structural elements represented by the same unprimed number. Both the rod shaped and ring shaped charging electrodes 112,120 are formed of an electrically conductive composite material including non-conducting, insulative binder and electrically conducting materials of the type used in the rotary head 52, as described before. In the preferred embodiment, the insulative material can be PEEK and the electrically conducting material can be carbon fibers. A suitable weight percentage of carbon fiber to the total weight of the composite is about 3 to 8 weight percent, and preferably about 5 to 6 weight percent of the total weight of the composite. Composites containing more than about 8 percent by weight carbon fiber appear to be too conducting, whereas composites containing less than about 3 percent by weight of carbon fiber appear to be too non-conducting. While a plurality of rod shaped charging electrodes 112 are preferred, it is within the terms of the invention to substitute a frustro-conically shaped charging electrode embedded in the wall 114 and extending from the threaded surface 116 of the mounting chamber 118 to flat, circular, ring shaped charging electrode 120.

The operation of the embodiment illustrated in FIG. 3 is essentially identical to the operation of the embodiment illustrated in FIG. 2 except that the electrostatic energy is directed from the high voltage generator 80 to drive shaft 40 and ultimately into atomizing head 52 via the threaded section 50 and the threaded surface 116. Then the electrostatic energy is directed into the rod shaped electrodes 112 and ring shaped electrode 120 to be imparted into coating material flowing over the surface 102' in the manner shown in the '770 patent listed before. This embodiment is particularly advantageous because the electrically non-conducting composite forming the head and the electrically conductive composite material forming the conductor rods and ring are similar in physical characteristics and do not have a tendency to separate under operating conditions, as was sometimes the case with the prior art heads.

It is apparent that there has been provided in accordance with this invention an apparatus for transferring high electrostatic charge through a motor drive shaft to a high speed head secured at one end thereof that satisfies the objects, means and advantages set forth hereinbefore. The apparatus includes several means of supplying high voltage electrostatic energy to the motor drive shaft which directs the energy into the rotary head so that the profile of the housing is reduced to substantially eliminate wrap back of paint onto the housing. Further several embodiments of rotary head construction provide long lasting, effective means for transferring charge into the coating material.

While the invention has been described in combination with embodiments thereof, it is evident that many alternatives, modifications, and variations will be apparent to those skilled in the art in light of the foregoing description. Accordingly, the invention is intended to embrace all such alternatives, modifications and variations as fall within the spirit and scope of the appended claims.

We claim:

1. A rotary atomizer, comprising:

a housing formed of a non-electrically conductive material having a forward end and a rearward end and defining an interior chamber therebetween;

rotary drive means disposed within said interior chamber and having a cup-shaped, atomizing head mounted thereto outside of said forward end of said housing for rotating said cup-shaped atomizing head about an axis of rotation extending longitudinally through said housing;

means for supplying coating material to said cup-shaped, atomizing head;

means for conducting high voltage electrostatic energy through said rotary drive means within said housing and into said cup-shaped, atomizing head without conducting said high voltage electrostatic energy through said non-electrically conductive material forming said housing; and said cup-shaped atomizing head being constructed of a composite material including a low capacitance insulating material and electrically conducting material whereby said high voltage electrostatic energy is transmitted from said rotary drive means through said cup-shaped, atomizing head to charge said coating material with said high voltage electrostatic energy by contact with at least a part of said electrically conducting material in said atomizing head.

2. The rotary atomizer of claim 1 wherein said atomizing head has a coating material flow surface forming a forward cavity whereby charged coating material flows outwardly across said flow surface and is flung radially outward to form atomized particles of charged coating material adapted for application to a workpiece.

3. The rotary atomizer of claim 1 wherein said drive means includes an air turbine motor coupled by a drive shaft to said atomizing head, said drive shaft having a bore aligned with said axis of rotation and extending therethrough.

4. The rotary atomizer of claim 3 wherein said means for supplying coating material to said atomizing head includes a feed tube removably received within said bore through said drive shaft and in communication with said atomizing head for supplying coating material to said flow surface of said atomizing head when said atomizing head is rotating about said axis of rotation.

5. The rotary atomizer of claim 4 wherein said means for conducting high voltage electrostatic energy through said rotary drive means includes means for supplying high voltage electrostatic energy to said drive shaft for conduction direction therethrough and into said atomizing head.

6. The rotary atomizer of claim 5 wherein said means for conducting high voltage electrostatic energy through said drive shaft includes means for directing said high voltage electrostatic energy through said feed tube removably received within said bore and into said drive shaft.

7. The rotary atomizer of claim 6 wherein said feed tube has a first end which is engaged with said motor so as to be supported in cantilevered fashion free of electrical contact with the wall of said bore and said feed tube has a second end in close proximity to said atomizing head.

8. The rotary atomizer of claim 5 wherein said means for supply high voltage electrostatic energy through said drive shaft includes means for directing high voltage electrostatic energy into turbine blades of said air turbine motor which in turn conduct said high voltage electrostatic energy into said drive shaft.

9. The rotary atomizer of claim 8 wherein said means for directing high voltage electrostatic energy into turbine blades includes charging electrode means mounted in close proximity to said turbine blades to form a gap whereby said high voltage electrostatic energy is transmitted across said gap and into said turbine blades.

10. The rotary atomizer of claim 3 wherein said means for conducting high voltage electrostatic energy through said rotary drive means includes means encircling said drive shaft for transmitting said high voltage electrostatic energy into said drive shaft.

11. The rotary atomizer of claim 10 wherein said means encircling said drive shaft are located in closely spaced proximity to said drive shaft to form a gap whereby said electrostatic energy is transmitted across said gap and into said drive shaft.

12. The rotary atomizer of claim 11 wherein said encircling means is a contact free, bearing device arranged in said motor housing for axially supporting said drive shaft in a non-contact state.

13. The rotary atomizer of claim 1 wherein said atomizing head has a mounting chamber and said rotary drive means comprises a drive shaft and an air turbine motor, the mounting chamber being threadedly secured to said drive shaft which is coupled to said air turbine motor, said atomizing head having a rear cavity disposed between said mounting chamber and a forward cavity having a flow surface, said rear cavity being separated by a divider from said forward cavity, a plurality of holes connecting said rear cavity to said forward cavity whereby said coating material delivered to said rear cavity can flow from said rear cavity through said holes to said forward cavity and across said flow surface just prior to being expelled therefrom in a charged state.

14. The rotary atomizer of claim 1 wherein said atomizing head has a larger diameter than the diameter of said forward end of said housing to substantially eliminate the wrap back of paint onto said housing.

15. The rotary atomizer of claim 1 wherein said electrically conducting material in said atomizing head forms charging electrode means embedded in said composite material and extending from said rotary drive means to a flow surface forming a forward cavity whereby coating material flowing outwardly across said flow surface is charged with said high voltage electrostatic energy by contact with said embedded electrode means and is flung radially outward to form atomized particles of charged coating material.

16. The rotary atomizer of claim 15 wherein said electrically conducting material in said atomizing head has a mounting chamber and said rotary drive means comprises a drive shaft and an air turbine motor, the mounting chamber being threadedly secured to said drive shaft which is coupled to said air turbine motor, said atomizing head having a rear cavity disposed between said mounting chamber and a forward cavity having a flow surface, said rear cavity being separated by a divider from said forward cavity, a plurality of holes connecting said rear cavity to said forward cavity whereby said coating material delivered to said rear cavity can flow from said rear cavity through said holes to said forward cavity and across said flow surface just prior to being expelled therefrom in a charged state.

17. The rotary atomizer of claim 16 wherein said charging electrode means embedded in said composite material extends from said mounting chamber to a flat, circular, ring-shaped charging electrode embedded in said flow surface.

18. The rotary atomizer of claim 17 wherein said charging electrode means is formed of an electrically conductive composite material including an electrically non-conducting binder material and an electrically conducting material.

* * * * *

UNITED STATES PATENT AND TRADEMARK OFFICE

CERTIFICATE OF CORRECTION

PATENT NO. : 5,346,139

DATED : September 13, 1994

INVENTOR(S) : Davis et al.

It is certified that error appears in the above-indentified patent and that said Letters Patent is hereby corrected as shown below:

On Column 6, Lines 30, (4th word), 36, and Column 7, Line 33 of the Patent, "FIG." should be "Fig.";

On Column 9, Line 67 of the Patent, "direction" should be "directly"; and

On Column 10, Line 14 of the Patent, "supply" should be "supplying".

Signed and Sealed this

Twenty-ninth Day of November, 1994

*Attest:*

Bruce Lehman

BRUCE LEHMAN

*Attesting Officer*

*Commissioner of Patents and Trademarks*